United States Patent [19]

Seiersen

[11] 4,236,133

[45] Nov. 25, 1980

[54] TRANSFORMER WITH FOIL WINDINGS

[75] Inventor: Ole S. Seiersen, Kokkedal, Denmark

[73] Assignee: Christian Rovsing A/S, Ballerup, Denmark

[21] Appl. No.: 6,903

[22] Filed: Jan. 26, 1979

[30] Foreign Application Priority Data

Jan. 30, 1978 [DK] Denmark ..... 441/78

[51] Int. Cl.[2] ..... H01F 15/14

[52] U.S. Cl. ..... 336/69; 336/183; 336/223

[58] Field of Search ..... 336/69, 70, 180, 183, 336/223, 232

[56] References Cited

U.S. PATENT DOCUMENTS 873,036 12/1907 Frank ..... 336/183

2,521,513 9/1950 Gray ..... 336/223

3,210,648 10/1965 Cockie ..... 336/70

FOREIGN PATENT DOCUMENTS 1513916 4/1970 Fed. Rep. of Germany ..... 336/69

7504229 4/1975 Netherlands ..... 336/69

939444 10/1963 United Kingdom ..... 336/69

*Primary Examiner*—Thomas J. Kozma

*Attorney, Agent, or Firm*—Fleit & Jacobson

[57] ABSTRACT

In a transformer of the type having spirally wound copper foil windings, capacitive signal transfer between the primary and secondary windings is avoided by placing the turns of the winding having the smaller number of turns in pairs and placing adjacent each of said turns the turn of the other winding having the same number as the said turn in the sequence of current passage.

3 Claims, 3 Drawing Figures

TRANSFORMER WITH FOIL WINDINGS

Figure 1:
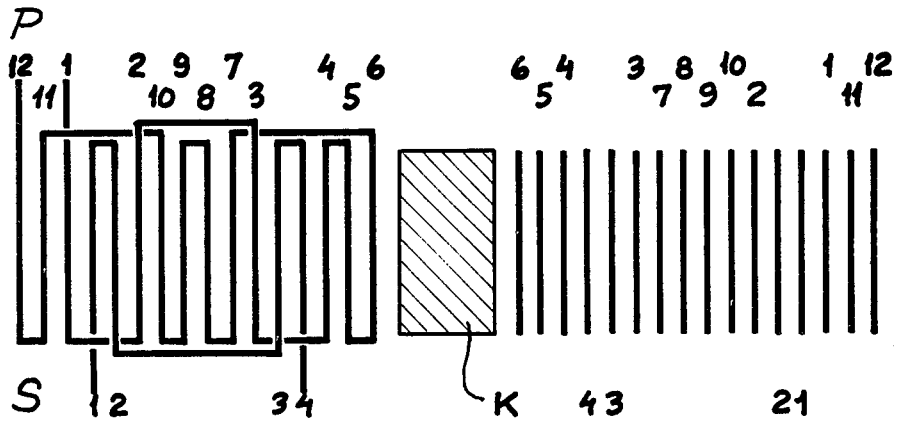

The invention relates to a transformer with a core onto which a primary winding and a secondary winding, which both consist of metal foil, are spirally wound. Such transformers may be employed for example as power converters in satellite circuits. The power converted may be of the order ½ kW and the frequency for example 20 kHz.

It is common knowledge to reduce electrostatic couplings brought about by winding capacities between transformer windings by positioning one or more electrostatic screens, for example in the form of copper foil, between the windings. However, such screens increase the distance between the windings and thus enhance the leakage induction.

This may be reduced by dividing one winding, for example the primary winding, into two parts located on their respective sides of the other winding. However, such arrangement doubles the number of electrostatic screens, and the windings will occupy more space, which in many cases is inacceptable.

The object of the invention is to provide a transformer of the subject type which makes it possible to minimize signal transfer through capacitive couplings between the two windings without enhancing the leakage induction and without employing electrostatic screens.

Said object is achieved in that the turns in the winding having fewest turns are divided into pairs of adjoining turns, and in that each turn in each pair has an adjacent turn forming part of the other winding and having the same number as the turn concerned in the order in which the turns conductively follow each other in the windings, seen from corresponding ends of the two windings. Said construction causes the voltages in the adjoining turns of the two windings to become almost equally large, making the capacitive signal transfer between these turns negligible, and as the turns in the subject form of winding act as electrostatic screens for one another, also the capacitive signal transfer between the windings becomes altogether negligible.

Another object of the invention is to provide a transformer of the type described having two or more secondary windings, wherein each of their turns are laid as an adjacent turn to the turn in the first secondary winding or in one of the other secondary windings having the same number seen from corresponding ends.

Still another object of the invention is to provide a transformer of the type described wherein each winding is a metal foil strip consisting of a plurality of straight sections parallel with one another and staggered with respect to one another more than the strip width, each of said sections having a length corresponding to one or more turns and being connected at the ends by transitions having such a dimension perpendicularly to the strips that after bending they permit the turns in question to be positioned in a radial distance from one another corresponding to the thickness of the intermediate turns and insulation layers. Said construction permits all the turns in each winding to be produced as one continuous strip of foil, for example by an etching process, even though in the finished winding they must be intertwined in a specific order deviating from the order in which the corresponding turns appear in the strip.

According to one embodiment of the invention all the turn sections in each metal foil strip are staggered to the same side with respect to the preceding one, seen from one end. Thereby savings in materials are obtained because several winding strips may be produced from the same sheet of foil.

Figure 2:
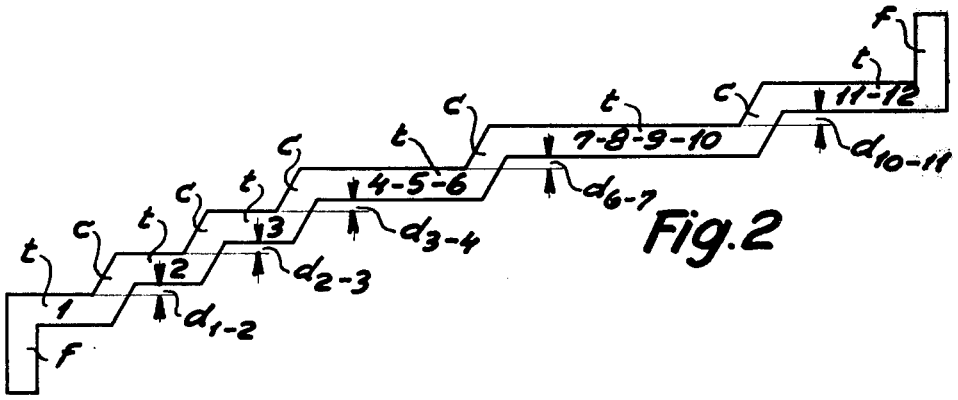
Figure 3:
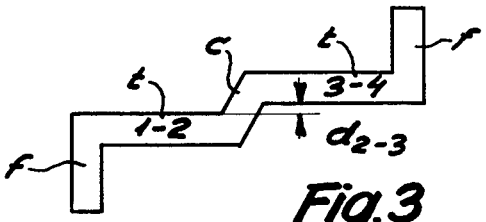

The invention will be explained more fully below with reference to the drawing, in which FIG. 1 is a diagram showing the location of the individual turns with respect to the core and to one another in an embodiment of the transformer according to the invention, and FIGS. 2 and 3 show the metal foil strips of which the primary winding and secondary winding respectively in this transformer are wound.

In FIG. 1 K designates the central core of a transformer. Around this core there is wound a primary winding P consisting of twelve turns P1–12 of copper foil whose width is substantially equal to the length of the central core, and a secondary winding S consisting of four foil turns S1–4. The windings are spirally wound onto the core, and the transformation ratio of the transformer is 3:1. Layers (not shown) of insulation material are placed between the turns.

The windings consist of metal foil strips, for example of copper, aluminium or silver, coated with an insulation material, for example in the form of a plastic strip adhered thereon or a plastic material sprayed thereon. Such strips for forming the primary winding P and the secondary winding S are shown in FIGS. 2 and 3 respectively. Each of them has a plurality of straight sections t which each forms one or more turns in the finished transformer and is marked with consecutive numerals indicating the numbers of these turns conductively, or in other words the order in which current passes through them. The sections t are parallel with one another and laterally staggered with respect to one another a distance exceeding the strip width so as to leave a distance d between the two side edges, which are located closest to each other, of each pair of adjacent sections, said distance d being at least just as large as the radial distance between the turns in question in the transformer. The circumference of the turns and thus the corresponding length of the section increase of course with the distance from the core K. The sections t are adjoined end to end by transitions c which in the shown embodiment form an angle of about 45° with the sections t. Moreover, each end section t is connected to a terminal f disposed perpendicularly thereto and serving for connecting external circuits.

In certain circumstances the inclined transitions make it possible to reduce the space requirement by avoiding overlappings; however, the transitions c may also be disposed perpendicularly to the sections 6, and they may also have other shapes than the one shown in the drawing. During the winding process the transitions are bent along lines forming extensions of the two innermost edges of the adjoining sections t. Hereby the turn sections t will be spirally located on top of each other, while the transitions c will be disposed in radial planes next to the windings.

The transitions c make it possible to wind the sections t onto the core K in the desired order, seen from the core to the outermost turn 12. This order is shown in FIG. 1 and differs from the order in which current passes through the turns, said current passage order being indicated by numerals. First turn 6 of the primary winding is wound onto the core K and then turns 5 and 4. The winding direction may be chosen as desired, and is here assumed to be clockwise. Turns 4 and 3 of the secondary winding are now wound onto turn P4, for example clockwise, too, and then turn 3 of the primary winding onto turn 3 of the secondary winding also clockwise. Then turns 7, 8, 9 and 10 of the primary winding are wound in a direction opposite the direction of turns P6-3, that is counterclockwise. The next turn P2 is wound clockwise, and so are also the following turns S2-1 of the secondary winding, which is now finished. The primary winding will be finished by winding its turn 1 clockwise and then its turns 11 and 12 counterclockwise.

The result of this winding program is, as appears from FIG. 1, that all the secondary turns are located immediately adjacent primary turns with the same numbers seen from one end of the strips, thus obviating the risk of appreciable voltage differences between the primary and secondary turns which are capacitively coupled to one another.

Capacitive signal transfer between the other primary turns and the secondary turns are prevented by the screen effect brought about by the turns themselves.

The transformer core as well as the windings may be constructed in other ways and of course the number of turns may also be changed.

I claim:

1. A transformer having a core onto which a primary winding and a secondary winding, which both consist of metal foil, are spirally wound and radial with respect to each other, the turns in the winding having the fewest turns being divided into pairs of contiguous turns, and each turn in each pair having an immediately adjacent turn of the other winding and the same number as said immediately adjacent turn in the order in which the turns conductively follow each other in the windings, seen from corresponding ends of the two windings.

2. A transformer according to claim 1, characterized in that each winding is a metal foil strip consisting of a plurality of straight sections parallel with one another and staggered with respect to one another more than the strip width, each of said sections having a length corresponding to one or more turns and being connected at the ends by transitions having such a dimension perpendicular to the strips that after bending they permit the turns in question to be positioned in a radial distance from one another corresponding to the thickness of the intermediate turns and insulation layers.

3. A transformer according to claim 2 characterized in that all the turn sections in each metal foil strip are staggered to the same side with respect to the preceding one seen from one end.

* * * * *